US006264549B1

(12) United States Patent
Kennedy et al.

(10) Patent No.: US 6,264,549 B1
(45) Date of Patent: Jul. 24, 2001

(54) MINE VENTILATION

(75) Inventors: William R. Kennedy; John M. Kennedy, both of Taylorville, IL (US)

(73) Assignee: Jack Kennedy Metal Products & Building, Inc., Taylorville, IL (US)

( * ) Notice: Subject to any disclaimer, the term of this patent is extended or adjusted under 35 U.S.C. 154(b) by 0 days.

(21) Appl. No.: 09/481,966

(22) Filed: Jan. 12, 2000

(51) Int. Cl.[7] ..... E21F 1/14
(52) U.S. Cl. ..... 454/169; 405/153
(58) Field of Search ..... 454/169, 170; 405/151, 153, 288; 52/86, 87, 332, 334, 358, 360, 588.1, 630, 713

(56) References Cited

U.S. PATENT DOCUMENTS

| | | | | |
|---|---|---|---|---|
| 1,923,008 | | 8/1933 | Proctor . | |
| 2,062,160 | | 11/1936 | Calkins et al. . | |
| 2,180,317 | | 11/1939 | Davis . | |
| 2,238,566 | | 4/1941 | Perrine . | |
| 2,264,100 | | 11/1941 | Smith . | |
| 2,333,908 | | 11/1943 | Wilkoff . | |
| 2,738,179 | * | 3/1956 | Joy | 454/169 |
| 3,738,083 | | 6/1973 | Shimano . | |
| 3,820,294 | | 6/1974 | Parker . | |
| 3,831,384 | * | 8/1974 | Kempster | 405/258 |
| 4,440,070 | * | 4/1984 | Baker et al. | 454/170 |
| 4,483,642 | | 11/1984 | Kennedy et al. . | |
| 4,621,951 | | 11/1986 | Dewson . | |
| 4,677,797 | | 7/1987 | Roth . | |
| 5,412,916 | | 5/1995 | Kennedy et al. . | |
| 5,466,187 | | 11/1995 | Kennedy et al. | 454/169 |

FOREIGN PATENT DOCUMENTS

| | | |
|---|---|---|
| 183694 | 3/1955 | (AU) . |
| 241008 | 10/1960 | (AU) . |
| 1382333 | 1/1975 | (GB) . |

OTHER PUBLICATIONS

Title: Steel Overcasts; Author: Jack Kennedy, Metal Products and Buildings, Inc.; pp. 3–9.

* cited by examiner

*Primary Examiner*—Harold Joyce
(74) *Attorney, Agent, or Firm*—Senniger, Powers, Leavitt & Roedel

(57) ABSTRACT

A tunnel-forming overcast structure for incorporation in the installation of an overcast construction at the intersection of two intersecting passages in a mine, each passage constituting an airway for flow of air for mine ventilation having an upstream and a downstream mouth at the intersection. The structure includes a pair of generally parallel side walls each having a top and a deck extending from the top of one of the side walls to the top of the other side wall and connected to the side walls. Each side wall comprises a plurality of elongate generally vertically extensible panels extending generally vertically in side-by-side relation. Each panel includes an upper member and a lower member, one of the members having a sliding fit in the other. The lower members are in a relatively non-extensible position with respect to the upper members in the structure and are ultimately extensible for completing walling off of the upstream and downstream mouths of one of the airways. A method of installing the structure is also disclosed.

17 Claims, 10 Drawing Sheets

MINE VENTILATION

BACKGROUND OF THE INVENTION

This invention, in general terms, relates to mine ventilation, and more particularly to:

(a) an overcast structure for the intersection of two passageways or airways in a mine, air flowing in each airway for ventilation, the installation as completed by-passing air flowing in one airway around the other at their intersection to avoid interference of the flows;

(b) the installation as completed at the intersection of the intersecting airways; and (c) the method of installation.

Reference is made to the coassigned U.S. Pat. No. 5,412,916 of William R. Kennedy and John M. Kennedy, dated May 9, 1995 entitled "Structure Having Quick-Connect Components" and the coassigned U.S. Pat. No. 5,466,187 of John M. Kennedy and William R. Kennedy, dated Nov. 14, 1995 entitled "Mine Ventilation Structure" for background, the second of these patents (the '187 patent) containing what is believed to be an ample discussion of what is meant by the term "overcast" and reasons for the installation of an overcast in a mine.

As described in said '187 patent, the installation of the preferred embodiment thereof involves first, the positioning of wing panels 30 in the first of the two intersecting passageways, followed by the erection of corresponding sections of side wall panels to form portions of the side walls 24 of the overcast tunnel 18. A deck 28 is applied simply resting at its ends on the side walls and end panels 32 are installed. While the procedure has generally been quite satisfactory and extensively used, and as described in said '187 patent may be erected quickly by only a few laborers who need no special knowledge of overcast instruction, it is still quite labor intensive.

While said '187 patent states (in column 3, lines 43–47 thereof) that either or both of the steel ends and wings may be omitted entirely by sizing the tunnel width to equal the mine entry width and/or the tunnel height to equal the mine entry height, this still entails the need of relatively intensive labor procedure in the mine.

SUMMARY OF THE INVENTION

Accordingly, among the several objects of this invention may be noted the provision of an overcast structure for installation at the intersection of two passages or airways in a mine without requiring extensive fabrication in the depths of the mine, thereby reducing even further the labor required for the installation in the mine; the provision of such an overcast structure which renders installation even simpler; the provision of such an overcast which is relatively economical to manufacture as well as being capable of partial pre-fabrication to reduce the work required in the mine; the provision of a stabilized stronger installation in a mine which incorporates said overcast structure effective for the air flow by-pass purpose; and the provision of a readily-carried-out method of carrying out the installation embodying the overcast structure at the intersection of the intersecting passages or airways in a mine.

In general, the invention in a first phase involves a tunnel-forming overcast structure for incorporation in the installation of an overcast construction at the intersection of two intersecting passages in a mine, each passage constituting an airway for flow of air for mine ventilation having an upstream and a downstream mouth at the intersection. The tunnel-forming overcast structure comprises a pair of generally parallel side walls each having a top and a deck extending from the top of one of the side walls to the top of the other connected to the side walls. Each side wall comprises a plurality of elongate generally vertically extensible panels extending generally vertically in side-by-side relation, each panel comprising an upper member and a lower member, one of said members having a sliding fit in the other. The lower members are in a relatively non-extended position with respect to the upper members in the structure, being ultimately extensible for completing walling off at least portions of the upstream and downstream mouths of one of the airways.

In a second phase, and in general, the invention involves an overcast construction comprising the stated tunnel-forming overcast structure with the upper panel members of the side walls in a raised position and the lower panel members thereof in a lowered position extending down from the upper panel members toward the floor of the airways to wall off at least portions of the upstream and downstream mouths of the one airway, the space between the side walls and below the deck constituting a tunnel for flow of air from the downstream to the upstream mouth of the other airway, the deck bottoming a passage in the roof establishing communication for flow of air from upstream of the wall closing the upstream mouth of said one airway to downstream of the downstream mouth of said one airway, whereby flow in said one airway is by-passed over flow through the tunnel.

In a third phase, and in general, the invention involves a method wherein the stated overcast structure is raised into final position and the extensible panels are extended down to effect the walling off of at least portions of the upstream and downstream mouths of the one airway.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
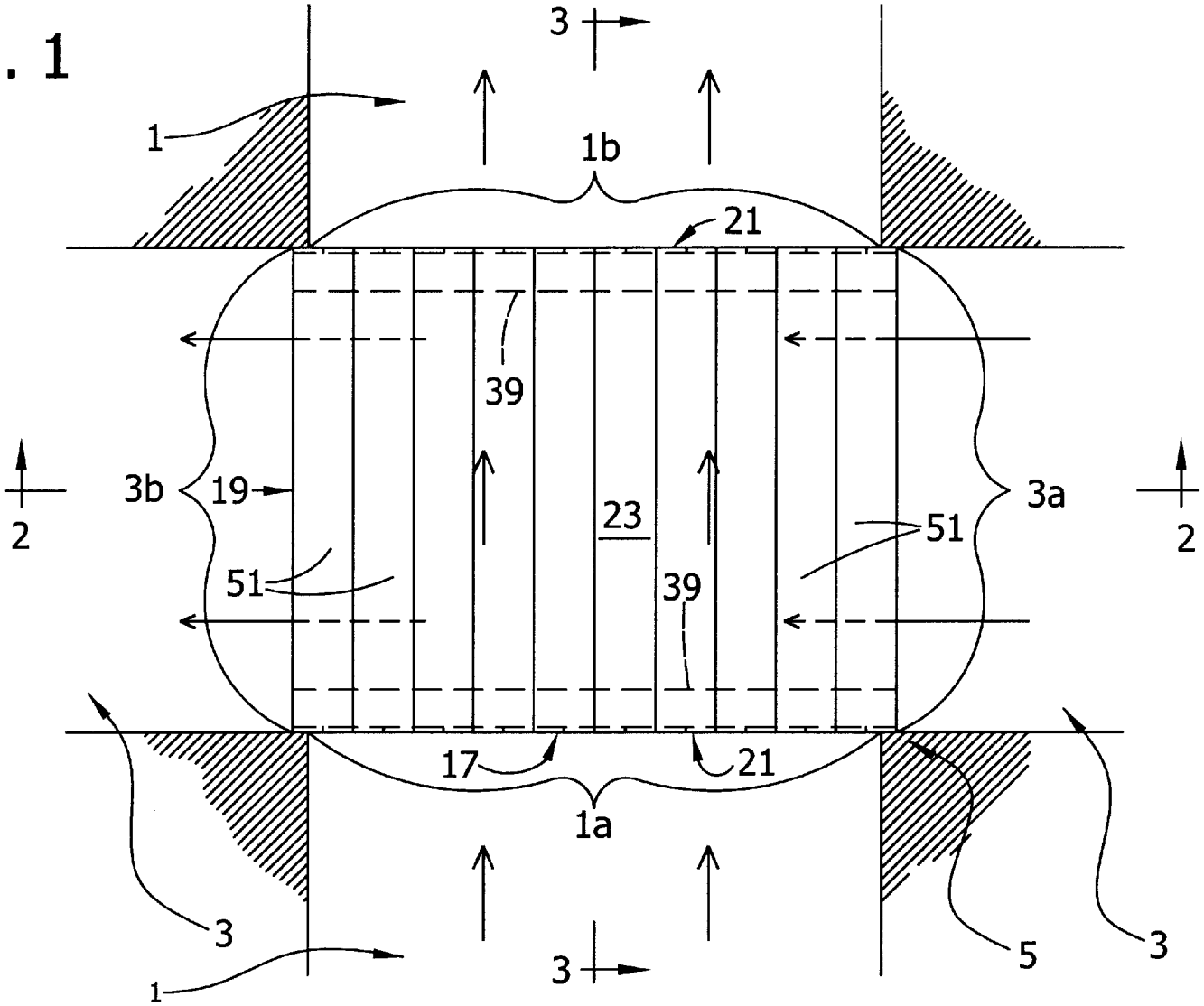
FIG. 1 is a view generally in horizontal section on the plane of the roof of two intersecting passages of a mine looking down, taken generally on line 1—1 of FIG. 2, showing an overcast construction of this invention at the intersection of the passages.
Figure 2:
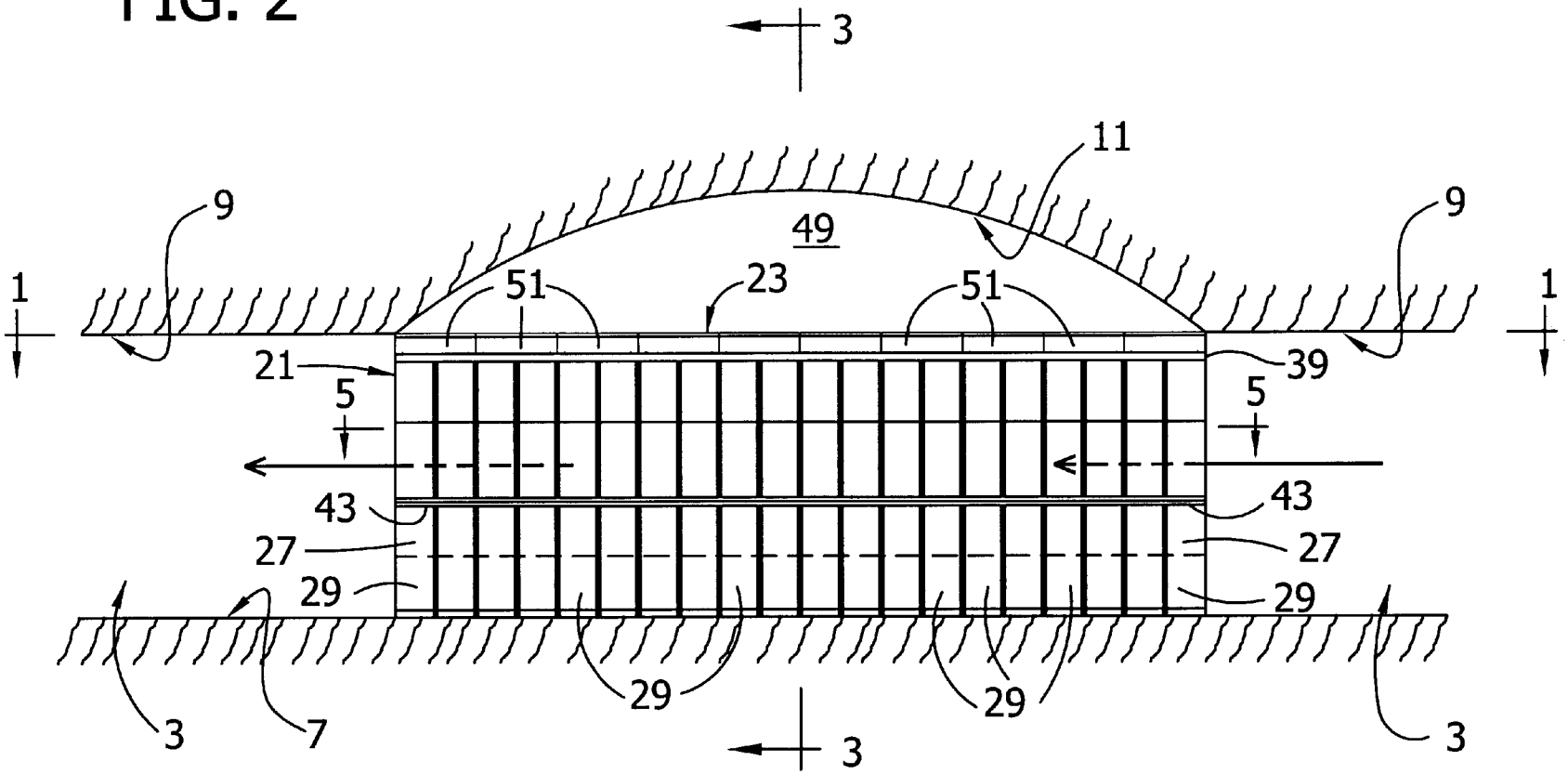
FIG. 2 is a view generally in vertical section on the central vertical longitudinal plane of one of the passages, taken generally on line 2—2 of FIGS. 1 and 3.
Figure 3:
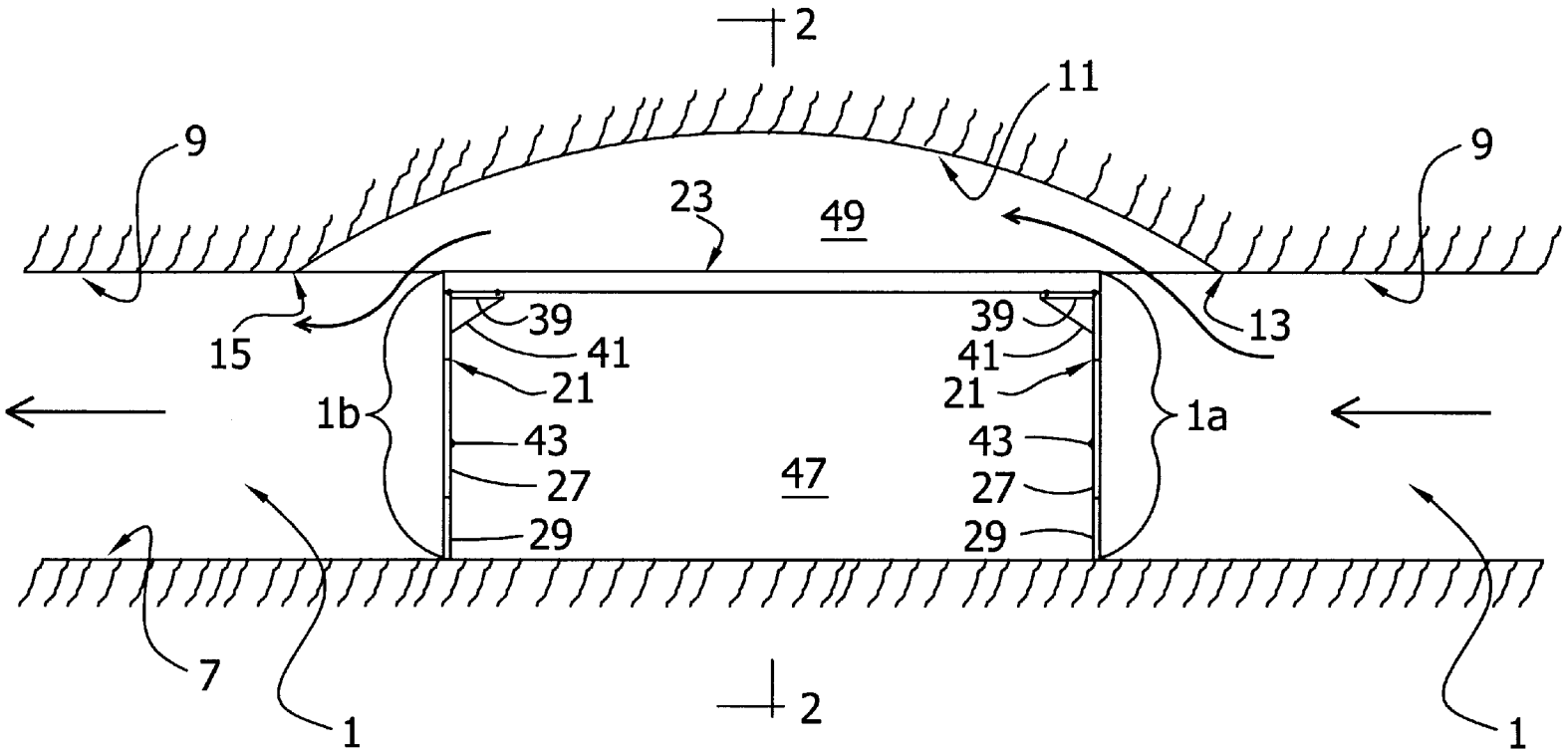
FIG. 3 is a view generally in vertical section on the central vertical plane of the other passage, taken generally on line 3—3 of FIGS. 1 and 2.

Referring to the drawings, first more particularly to FIG. 1, indicated at 1 and 3 are two intersecting passages in a mine, typically a coal mine, each passage constituting an airway for flow of air as indicated by the arrows in FIG. 1 for mine ventilation. Airway 1 may be referred to as the first airway, airway 3 as the second. Each airway has an upstream and downstream mouth at the intersection, said intersection being generally indicated by the reference numeral 5, the upstream and downstream mouths of airway 1 being indicated at 1*a* and 1*b*, respectively, and the upstream and downstream mouths of airway 3 being indicated at 3*a* and 3*b*, respectively. The floor in the airways and the intersection is indicated at 7, and the roof in the airways and intersection is indicated generally at 9 (see FIGS. 2 and 3), the roof having a dome formation 11 extending from a point 13 somewhat upstream of the upstream mouth 1*a* of airway 1 to a point 15 somewhat downstream of the downstream mouth 1*b* of airway 1 (see FIG. 3). Airway 1 is shown as somewhat wider than airway 3; it will be understood that the airways may be of substantially the same width.

Occupying the intersection 5 is an overcast construction designated in its entirety by the reference numeral 17 built in accordance with this invention comprising a tunnel-forming overcast structure designated in its entirety by the reference numeral 19. This structure comprises a pair of generally parallel side walls, each designated in its entirety by the reference numeral 21 of such height as to wall off at least portions of a respective mouth 1*a*, 1*b* of airway 1 (and preferably the entire mouth), and further comprising a deck designated in its entirety by the reference numeral 23 spanning the side walls 21 at the top and connected thereto. The side walls are spaced apart a distance corresponding to the width of airway 3.

Each of the side walls 21 of the tunnel-forming overcast structure 19 comprises a plurality of elongate generally vertically extensible panels, each panel being designated 25 in its entirety, the panels in each side wall extending generally vertically in side-by-side relation. As herein illustrated, each side wall is arbitrarily shown as comprising twenty such panels. Each panel is generally similar to the panel used in the mine stopping shown in the coassigned U.S. Reissue Pat. No. Re. 32,675 dated May 24, 1988 and in U.S. Pat. No. 4,820,081 of John M. and William R. Kennedy dated Apr. 11, 1989, both of which are incorporated herein by reference, each said panel comprising an upper member herein numbered 27 and a lower member herein numbered 29, the latter having a telescoping sliding fit in the former (the reverse of that illustrated in said mine stopping patents and as described in lines 14–16 of column 4 of the aforesaid Reissue Patent Re. 32,675). Each of the upper and lower panel members is a sheet metal member generally of channel shape in cross-section having a web 31 and flanges 33, each flange having an inturned portion 35 and a lip 37 (corresponding to web 21, flanges 23, inturned portions 25 and lips 27 of Re. 32,675.

Figure 10:
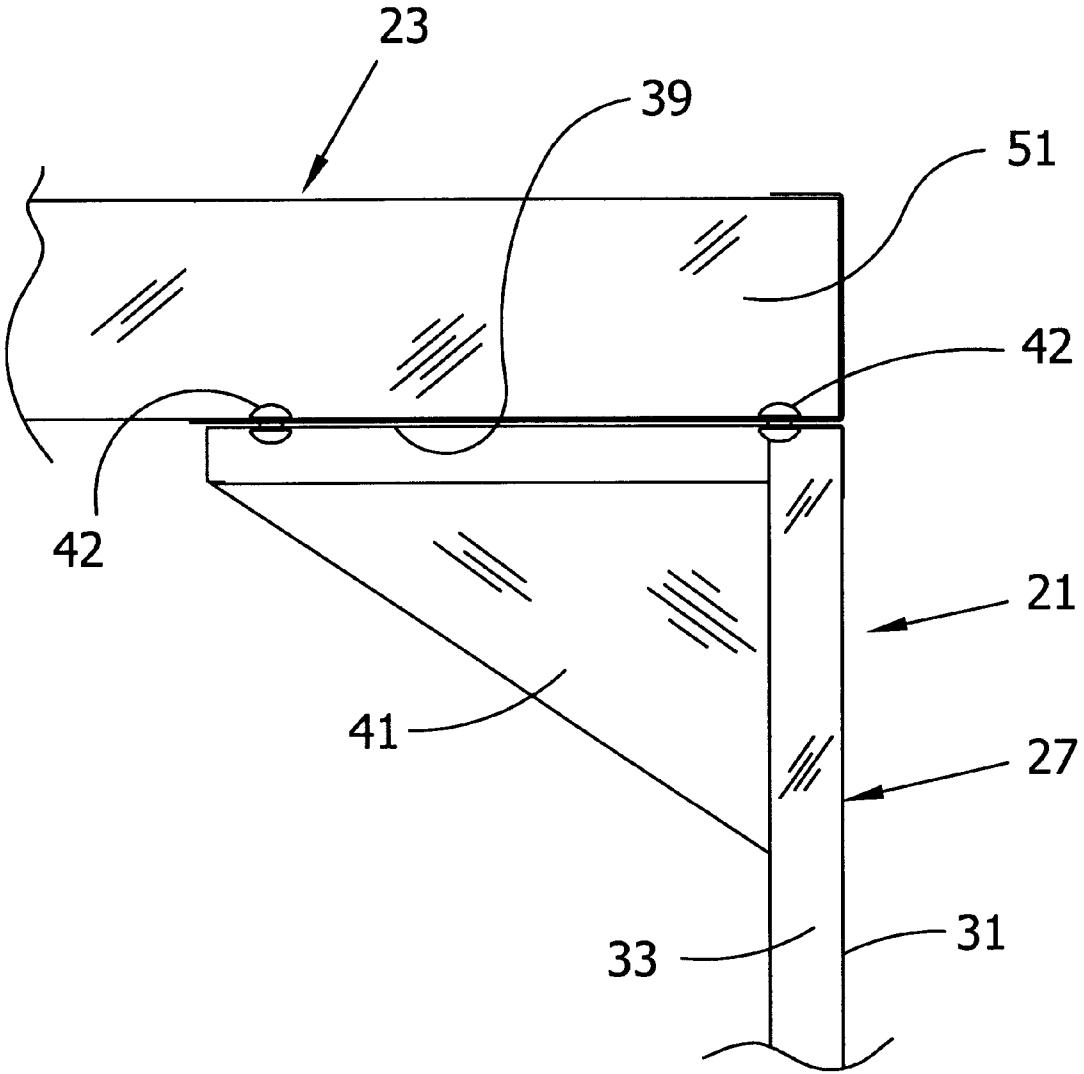
FIG. 10 is a view similar to FIG. 6 illustrating a modification.

Each side wall 21 has a shelf or header 39 at the top extending over the upper ends of the upper panel members thereof corresponding to shelf 70 of U.S. Pat. No. 5,412,916 which is incorporated herein by reference. The shelf is suitably secured on the upper panel members 27 of the twenty panels of each side wall 21 (as by welding) and may have the support of gussets 41 corresponding to those shown at 74 in this '916 patent. The deck 23 is essentially the same as that shown in the '916 patent but, instead of merely resting at its ends on the side walls, is connected to the shelf and thus to the upper panel members 27 of the extensible panels 25 of the side walls. The connection of the deck 23 to each shelf may be generally the same as the bayonet-slot type of connection shown in the aforesaid U.S. Pat. No. 5,412,916, which is incorporated herein by reference and to which resort may be had for details. It may be preferred, however, that the deck be rigidly fastened to the shelves and thus to the side walls as by riveting, as indicated at 42 in FIG. 10, to constitute a structure wherein the deck is in effect a fixed beam so that the structure is of greater strength than that achieved with the bayonet connection means of the '916 patent.

Figure 5:
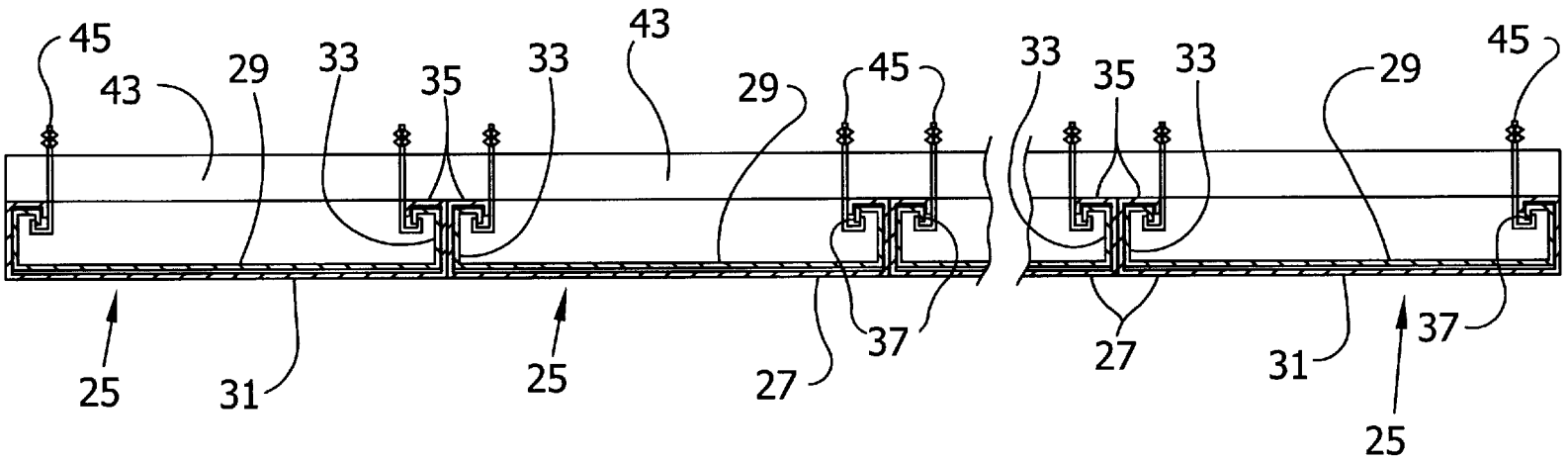
FIG. 5 is a view in horizontal cross-section generally on line 5—5 of FIG. 2 on a larger scale than FIG. 2 and broken away generally in the middle.
Figure 6:
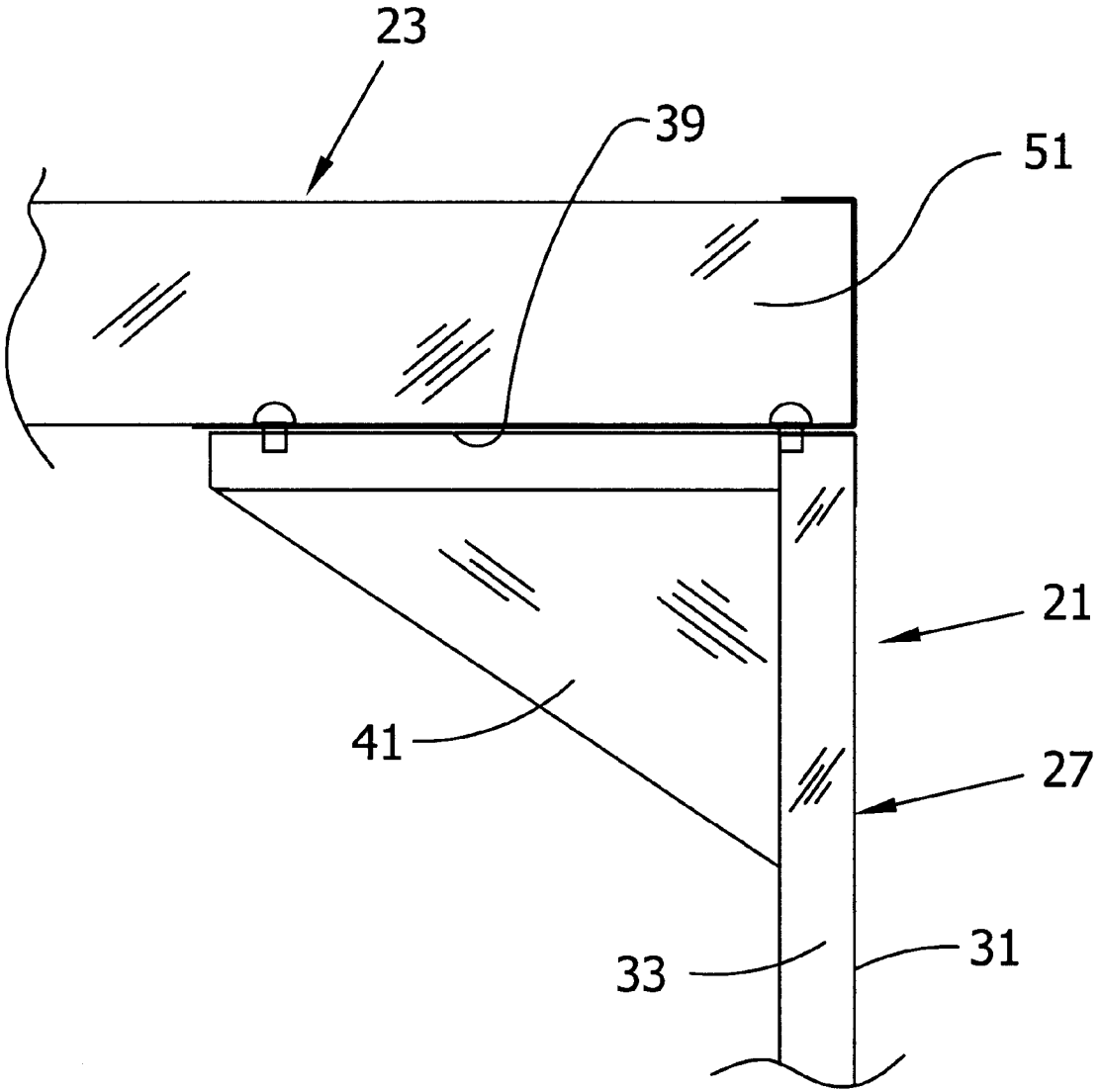
FIG. 6 is an enlarged vertical cross-section generally on line 6—6 of FIG. 4.

Thus, as to each side wall 21, the upper panel members 27 of the twenty panels 25 extend down from the respective shelf 39 in side-by-side relation with their webs 31 generally in the same vertical plane and with the flanges 33 of adjacent upper panel members 27 in face-to-face engagement (see FIG. 5), and the lower panel members 29 extend down from the upper panel members 27 to the floor 7. The panels 25 are held in the stated relation by reason of the upper panel members 27 being fastened to the shelf or header 39 and by means of a bar 43, more particularly an angle iron, and wire ties 45 in generally the same manner as shown for the bars and wire ties in our aforesaid mine stopping patents. The bars and wire ties are applied after the lower panel members 29 have been pulled down to the floor, being applied at an elevation above the lower ends of the upper panel members 27 and below the upper ends of the lower panel members 29, as will be subsequently mentioned in conjunction with explanation of installation procedure.

The tunnel-forming overcast structure 19 extends across the intersection 5 with the side walls 21 thereof walling off the upstream and downstream mouths 1*a* and 1*b*, respectively, of the first airway 1 by having the top of their upper panel members 27 in raised position with respect to the roof 9 and their lower panel members 29 in the lowered position extended down from the upper panel members 27 toward the floor 7. The lower ends of members 29 are shown as directly engaging the floor; they could be engaged with a strip of sealing material (not shown). The space 47 between the side walls 21 and below the deck 23 constitutes a tunnel for flow of air from the upstream mouth 3*a* to the downstream mouth 3*b* of the second airway 3. The deck 23 bottoms a passage 49 in the roof at the intersection 5 establishing communication for flow of air from upstream of the side wall 21 closing the upstream mouth 1*a* of the airway 1 to downstream of the first downstream mouth 1*b* of the airway 1 whereby flow in airway 1 is by-passed over the flow of air flowing in second airway 3 through the tunnel 47.

Figure 4:
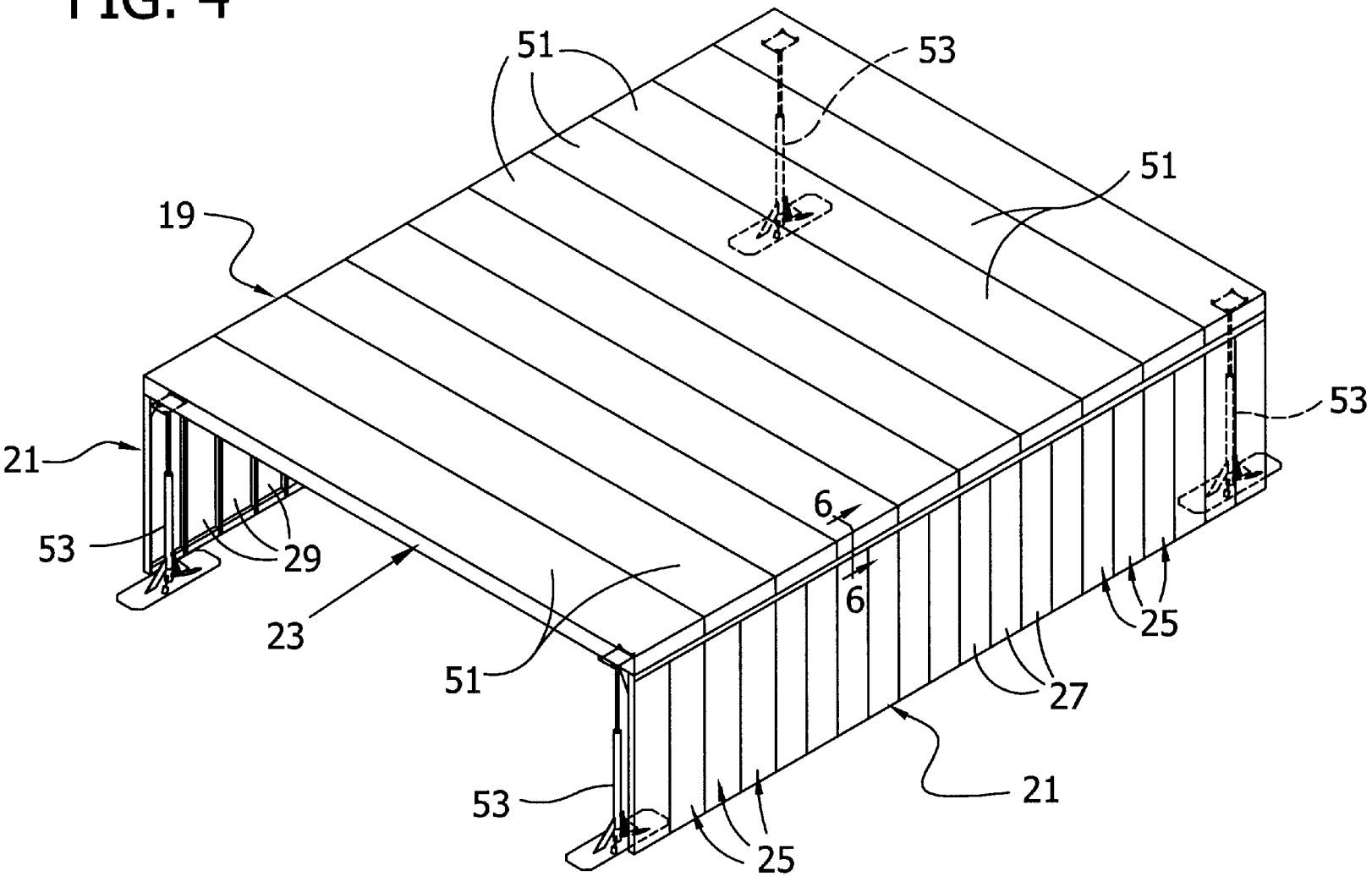
FIG. 4 is a view generally in perspective of a tunnel-forming overcast structure as built for incorporation in the installation of the overcast construction shown in FIGS. 1, 2 and 3, showing the structure in an initial state and in an initial position with respect to the method of installing the structure in the invention.

The installation of the above-described overcast construction 17 involves in its preliminary stage the preparation in the mine of the tunnel-forming overcast structure 19 with the lower panel members 29 of the vertically extensible panels 25 of the side walls 21 in the relatively non-extended position with respect to the upper panel members 27 in which they appear in FIG. 4, prior to their ultimate extension and addition of the bar 43 and wire ties 45. For the preparation of the overcast structure 19, prefabricated side walls 21 (each comprising the twenty extensible panels 25 and the shelf or header 39) are transported into the mine and brought to the intersection 5 with the lower panel members 29 in the non-extended or retracted position for the transport.

Deck panels 51 are transported into the mine and brought to the intersection 5. The side walls 21, with the lower panel members 29 in the non-extended or retracted position, are placed in vertical position in the mouths 1*a* and 1*b* of the airway 1 and the deck panels 51 are assembled therewith to complete the overcast structure 19 as shown in FIG. 4. Thus, at this stage, the tunnel-forming overcast structure 19 per se (constituting one of the phases of this invention) comprises the pair of generally parallel side walls 21 each having a top constituted by the respective shelf or header 39 and the deck 23 extending from the top of one of the side walls to the top of the other connected to the side walls. Each side wall 21 comprises a plurality (e.g., twenty) of the elongate generally vertically extensible panels 25 extending generally vertically in side-by-side relation, each panel comprising upper member 27 and lower member 29, one of these members (the lower) having a sliding fit in the other (the upper member). The lower panel members 29 are in the relatively non-extended (retracted) position with respect to the upper panel members shown in FIG. 4, being ultimately extensible for completing walling off at least portions of the upstream and downstream mouths 1*a* and 1*b* of the airway 1.

The tunnel-forming overcast structure 19 as shown in FIG. 4 with the lower panel members 29 in the retracted (contracted) position is of substantially less height than that of the mouths of the airways. The height of the side walls 21 Der se with the lower panel members 29 in their retracted (contracted) position and with the side walls 21 bearing on the floor 7 is such that, with the side walls 21 erected at the mouths 1*a* and 1*b* of airway 1, the shelves or headers 39 are at such a level as is reachable by workmen to emplace the deck panels 51 and connect them to the side walls.

Figure 7:
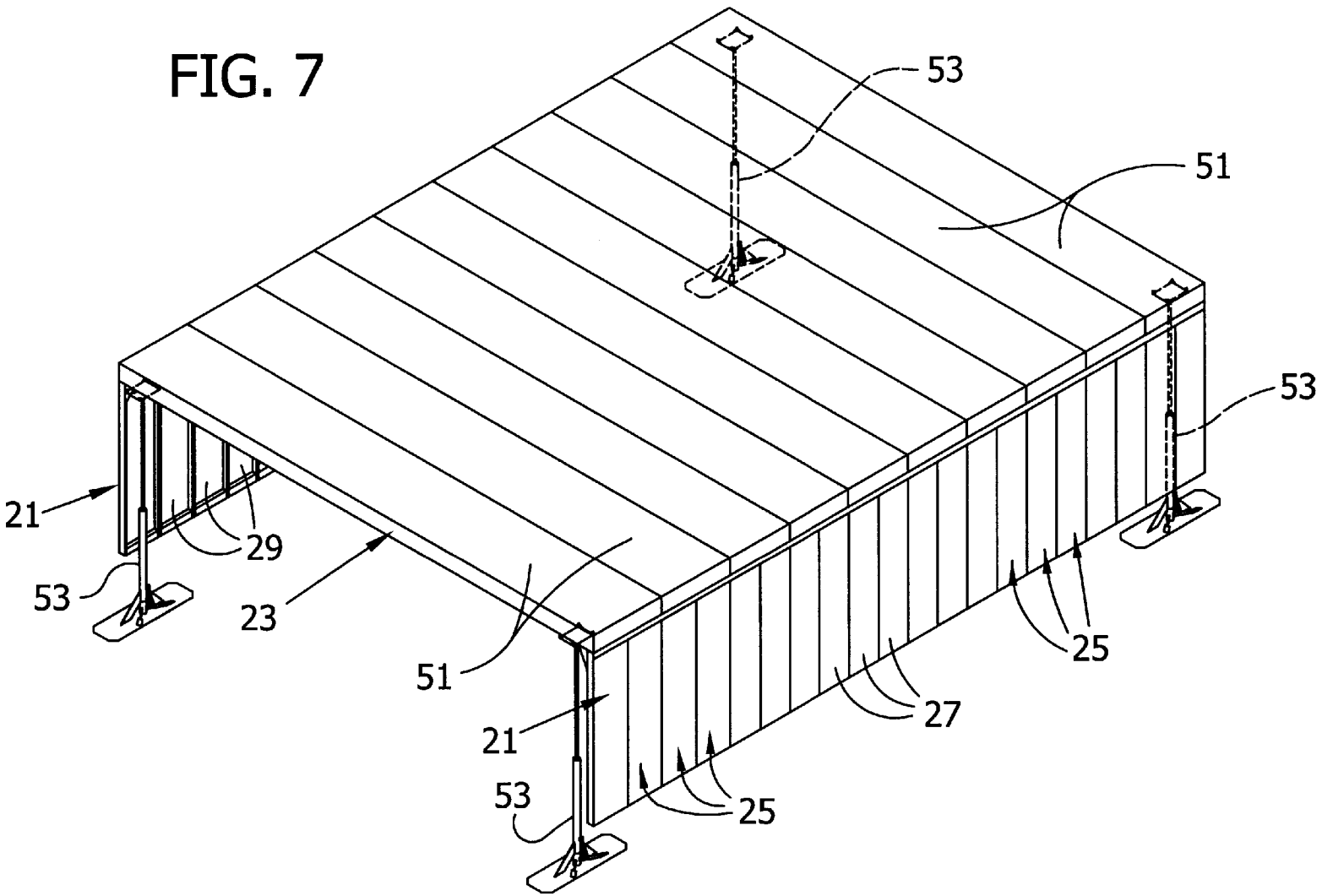
FIG. 7 is a view similar to FIG. 4 illustrating the step in the method of this invention involving the raising into position of the tunnel-forming overcast.
Figure 8:
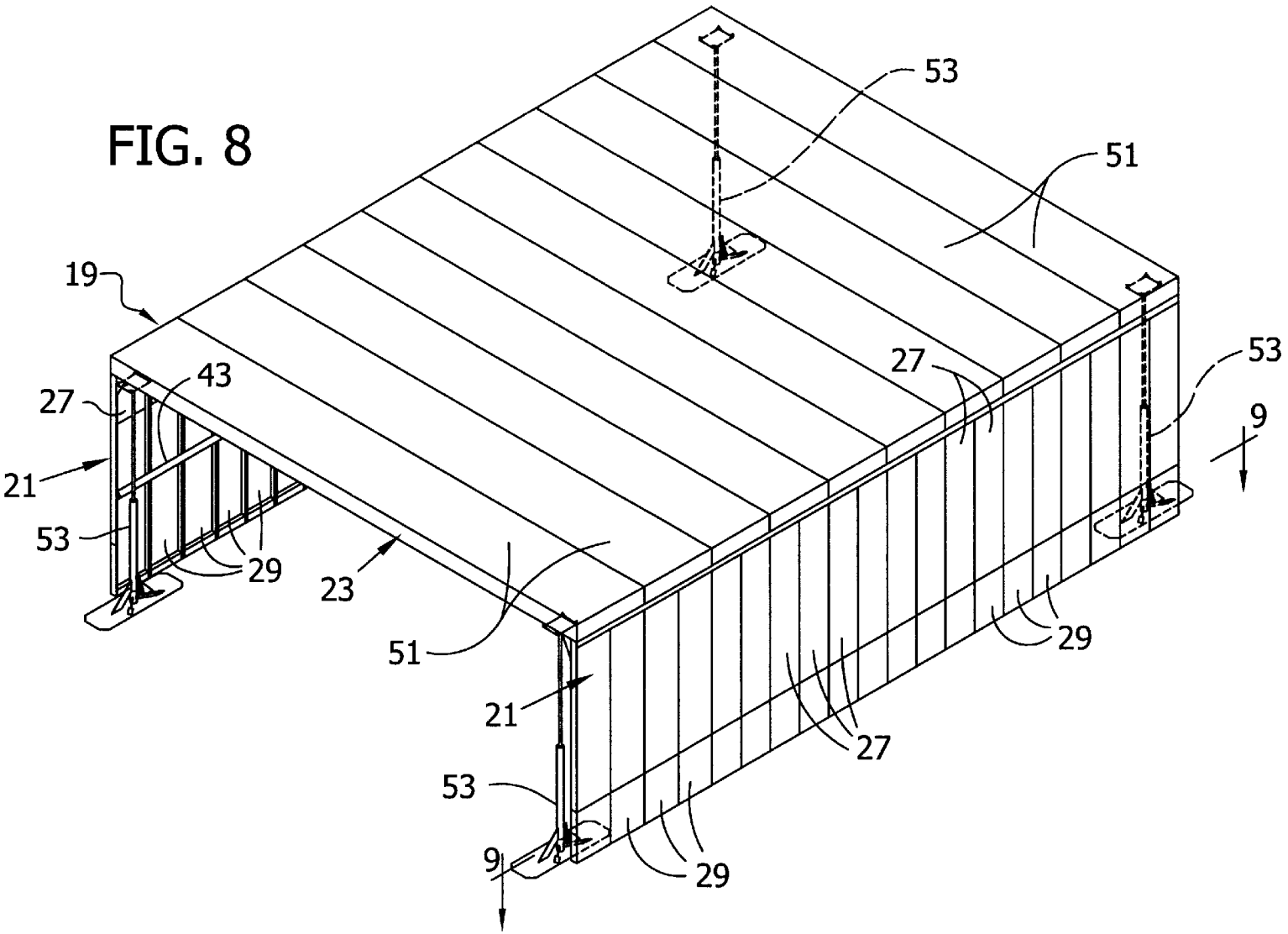
FIG. 8 is a view similar to FIG. 7 illustrating further steps.
Figure 9:
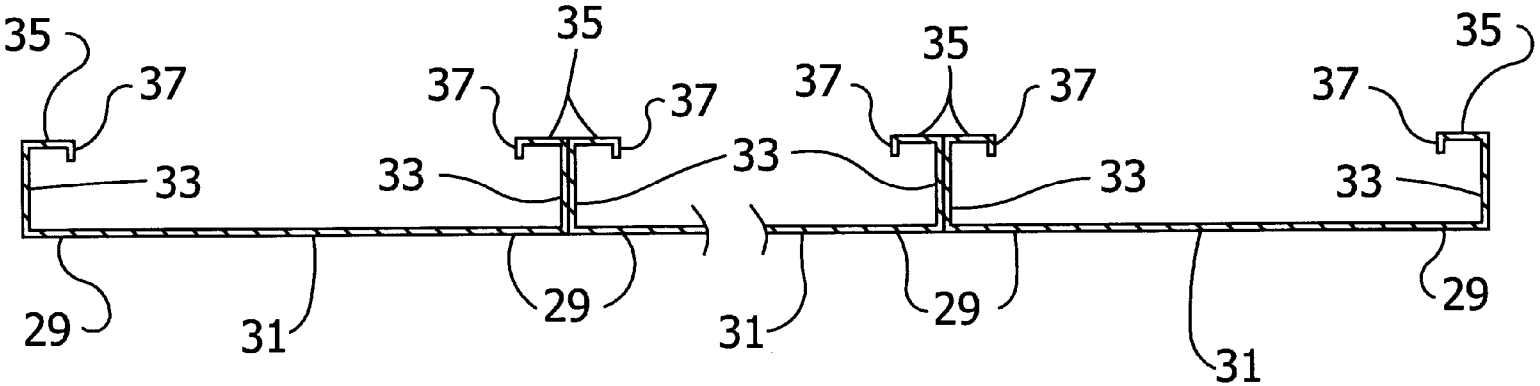
FIG. 9 is a view in horizontal cross-section generally on line 9—9 of FIG. 8, on a larger scale, broken away in the middle.

Referring to FIG. 4, the tunnel-forming overcast structure 19 as above described with the lower panel members 29 in the retracted or contracted mode and with their lower ends at the floor 7, is shown in its condition extending across the intersection 5 with the side walls 21 in position at the upstream and downstream mouths 1*a* and 1*b* of the airway 1 and the deck 23 extending across the intersection ready for the next step in the method of this invention for completing installation thereof in the final overcast construction 17 at the intersection. In the FIG. 4 condition of the overcast structure 19, the deck 23 is at a level intermediate the floor 7 and the level of the roof 9 of the airways. The overcast structure 19 is raised by jacking it up to the point in which it is shown in FIG. 7 where the deck 23 is generally at an elevation toward the roof 9 of the airways 1 and 3. In the preferred embodiment, the deck is raised to a point where it is generally at the level of the roof 9 of the airways 1, 3 and the tops of the side walls 21 are generally at the tops of the upstream and downstream mouths of the 1*a*, 1*b* of the airway 1. However, it will be understood that the overcast structure may be jacked up to a greater or lesser height. If the structure is jacked up to a lesser height, it may be desireable to install end panels of the type referred to in aforementioned U.S. Pat. No. 5,466,187 between the deck and the roof. The structure may be jacked up to a greater height, depending on the extent of the dome formation in the roof. In any event, the jacking operation is effected by means of several jacks, e.g., four jacks 53, one at each corner of the structure 19. For longer structures, the use of additional jacks toward the middle of the structure may be preferred. Each jack 53 is generally of the same type as that disclosed in the aforesaid U.S. Reissue Pat. No. Re. 32,675 to which reference may be had for full details. Preferably, however, the overcast jack 53 has a larger base and is not offset to fit into an extensible panel 25. Moreover, the jack 53 preferably has a longer stroke (e.g., 30 in.).

Following the jacking up of the structure 19, the extensible panels 25 of the side walls are extended down toward the floor 7 (i.e., the lower panel members 29 are pulled down) to effect walling off the upstream and downstream mouths 1*a*, 1*b* of the airway 1. With the lower panel members 29 down, the angle irons 43 and wire ties 45 are applied, stabilizing the construction and locking the lower panel members 29 in their wall-completing downwardly extended position. The deck 23, in its raised position, bottoms passage 49 in the roof defined by the domed formation 11, said passage establishing communication above the deck 23 for flow of air from upstream of the wall 21 closing the upstream mouth 1*a* of airway 1 to downstream of the downstream mouth 1*b* of airway 1, whereby flow in airway 1 is by-passed over flow through the tunnel-forming overcast structure 19.

It will be understood that, in most cases, the side walls 21 of the overcast structure will extend the full width of the mouths 1*a*, 1*b* of the airway being walled off. However, it will be understood that the side walls may have width less than the full width of the mouths without departing from the scope of the present invention. In such a case, wing panels 30 referred to in aforementioned U.S. Pat. No. 5,446,187 may be used to wall off the remaining width of the mouths.

In view of the above, it will be seen that the several objects of the invention are achieved and other advantageous results attained.

As various changes could be made in the above constructions and method without departing from the scope of the invention, it is intended that all matter contained in the above description or shown in the accompanying drawings shall be interpreted as illustrative and not in a limiting sense.

What is claimed is:

1. A tunnel-forming overcast structure for incorporation in the installation of an overcast construction at the intersection of two intersecting passages in a mine, each passage constituting an airway for flow of air for mine ventilation having an upstream and a downstream mouth at the intersection, said structure comprising a pair of generally parallel side walls each having a top and a deck extending from the top of one of the side walls to the top of the other side wall and connected to the side walls, each side wall comprising a plurality of elongate generally vertically extensible panels extending generally vertically in side-by-side relation, each panel comprising an upper member and a lower member, one of said members having a sliding fit in the other, the lower members being in a relatively non-extended position with respect to the upper members in the structure and being ultimately extensible for completing walling off at least portions of the upstream and downstream mouths of one of the airways.

2. An overcast structure as set forth in claim 1 wherein the deck is rigidly connected with the side walls.

3. An overcast structure as set forth in claim 1 wherein each side wall has a shelf at the top thereof, the deck being connected to the shelves.

4. An overcast structure as set forth in claim 3 wherein the deck is rigidly connected to the shelves.

5. An overcast structure as set forth in claim 1 wherein said two passages are constituted by first and second passages, said side walls being spaced apart a distance corresponding to the width of the second passage, and wherein the extensible panels are ultimately extensible for walling off the upstream and downstream mouths of the first passage.

6. In a mine having first and second intersecting passages constituting first and second airways for flow of air for mine ventilation, each airway having an upstream and a downstream mouth at the intersection of the airways, said airways and intersection having a floor and a roof, an overcast construction at said intersection comprising a tunnel-forming overcast structure comprising a pair of generally parallel side walls each of such height as to wall off at least a portion of a respective mouth of the first airway, said structure further comprising a deck spanning the side walls and connected thereto, said side walls being spaced apart a distance corresponding to the width of the second airway, each side wall comprising a plurality of elongate generally vertically extensible panels extending generally vertically in side-by-side relation, each panel comprising an upper member and a lower member, one of said members having a sliding fit in the other, said structure extending across the intersection with the side walls thereof walling off at least portions of the upstream and downstream mouths of said first airway by having the top of their upper members in a raised position with respect to said roof and their lower members in a lowered position extended down from the upper members toward said floor, the space between the side walls and below the deck constituting a tunnel for flow of air from the upstream to the downstream mouth of the second airway, the deck bottoming a passage in said roof establishing communication for flow of air from upstream of the wall closing the upstream mouth of said first airway to downstream of the downstream mouth of said first airway, whereby flow in said first airway is by-passed over flow through the tunnel.

7. The overcast construction of claim 6 wherein the deck is rigidly connected with the side walls.

8. The overcast construction of claim 6 wherein each side wall has a shelf at the top thereof, the deck being connected to the shelves.

9. The overcast construction of claim 8 wherein the deck is rigidly connected to the shelves.

10. The overcast construction of claim 6 wherein each side wall has a bar extending thereacross fastened to the extensible panels thereof at a level between the lower ends of the upper panels and the upper ends of the lower panels.

11. The overcast construction of claim 10 wherein each bar is fastened to the respective extensible panels by wire ties.

12. The method of installing an overcast structure in the intersection of two intersecting airways of a mine, each airway having an upstream and a downstream mouth at said intersection, said airways and intersection having a floor and a roof, said structure comprising a pair of generally parallel side walls each having a top and a deck extending from the top of one of the side walls to the top of the other side wall and connected to the side walls, each side wall comprising a plurality of elongate generally vertically extensible panels extending generally vertically in side-by-side relation, each panel comprising an upper member and a lower member, one of said members having a sliding fit in the other, said method starting with the overcast structure having the panels of its side walls in a contracted mode shorter than the height of the airway mouths and with the side walls of said structure in position at the upstream and downstream mouths of one of the airways and the deck extending across the intersection at a level intermediate said floor and the level of the roof of the airways, raising said structure to the point where the deck is at a higher elevation toward the level of the roof of the airways, then extending the lower panel members of the side walls down toward the floor to effect walling off of at least portions of said upstream and downstream mouths of said one airway, the deck as raised bottoming a passage in the roof thereabove establishing communication for flow of air from upstream of the wall closing the upstream mouth of said one airway to downstream of the downstream mouth of said one airway, whereby flow in said one airway is by-passed over flow through the structure.

13. The method of claim 12 wherein after the panel members have been extended down, a bar is applied to each side wall extending thereacross at a level between the lower ends of the upper panels and the upper ends of the lower panels and fastened thereto.

14. The method of claim 13 wherein each bar is fastened to the panels by twisting wire ties.

15. The method of claim 12 wherein the raising of the structure is effected by jacking it up.

16. The method of claim 15 wherein the jacking up is effected by operation of jacks at each corner of said structure.

17. The method of claim 12 wherein the structure is raised to a point where the deck is generally at the level of the roof of the airways and the tops of the side walls and generally at the tops of the upstream and downstream mouths of said one airway.

* * * * *